US008114792B2

(12) United States Patent
Kuang et al.

(10) Patent No.: US 8,114,792 B2
(45) Date of Patent: Feb. 14, 2012

(54) THREE-DIMENSIONAL WOVEN HOLLOW LAYER-CONNECTING FABRIC

(75) Inventors: Ning Kuang, Nanjing (CN); Liquan Zhang, Nanjing (CN); Jianzhong Zhang, Nanjing (CN); Fangtian Hu, Nanjing (CN); Hongwei Guo, Nanjing (CN)

(73) Assignee: Sinoma Science & Technology Co. Ltd., Nanjing, Jiangsu Province (CN)

( * ) Notice: Subject to any disclaimer, the term of this patent is extended or adjusted under 35 U.S.C. 154(b) by 414 days.

(21) Appl. No.: 12/279,489

(22) PCT Filed: Jan. 11, 2007

(86) PCT No.: PCT/CN2007/000067

§ 371 (c)(1), (2), (4) Date: Oct. 23, 2008

(87) PCT Pub. No.: WO2007/093109

PCT Pub. Date: Aug. 23, 2007

(65) Prior Publication Data

US 2009/0061712 A1 Mar. 5, 2009

(30) Foreign Application Priority Data

Feb. 15, 2006 (CN) ..... 2006 1 0038306

(51) Int. Cl.
*D03D 11/00* (2006.01)

(52) U.S. Cl. ..... 442/205; 442/203; 442/204; 442/206; 442/207

(58) Field of Classification Search ..... 442/203, 442/204, 205, 206, 207
See application file for complete search history.

(56) References Cited

U.S. PATENT DOCUMENTS 3,616,164 A * 10/1971 Tanimoto et al. ..... 442/358

FOREIGN PATENT DOCUMENTS

| | | | |
|---|---|---|---|
| CN | 1095001 | C | 11/2002 |
| EP | 1 489 211 | A2 | 12/2004 |
| JP | 1-162841 | A | 6/1989 |
| JP | 2004-256933 | A | 9/2004 |
| WO | WO 01/25519 | A1 | 4/2001 |

* cited by examiner

*Primary Examiner* — Andrew Piziali
(74) *Attorney, Agent, or Firm* — Scully, Scott, Murphy & Presser, P.C.

(57) ABSTRACT

The present invention relates to a three-dimensional woven hollow layer-connecting fabric, comprising an upper layer-surface (10) formed by crossing upper ground warp yarns (1), (2) and a weft yarn (3) and a lower layer-surface (11) formed by crossing lower ground warp yarns (4), (5) and a weft yarn (6); the weft yarns (3) and (6) on the upper and lower layer-surfaces are also crossed with poil warps (7), (8) besides ground warp yarns (1), (2) and (4), (5) on their own layer-surface; the spatial walking direction of poil warps (7), (8) woven from one layer-surface to another is opposite to the weft-inserting direction of the fabric. The framework feature of the composite layer-connecting fabric of the present invention is distinct, and the vertical support function of poil warps between two layer-surfaces is good. The spatial structure of the layer-connecting fabric is varied in conformation, easy to design and adapted to produce on a large scale. The compositely-strengthened material has the characteristics, such as anti-corrosion, anti-penetration, light weight and excellent physical mechanical properties.

4 Claims, 3 Drawing Sheets

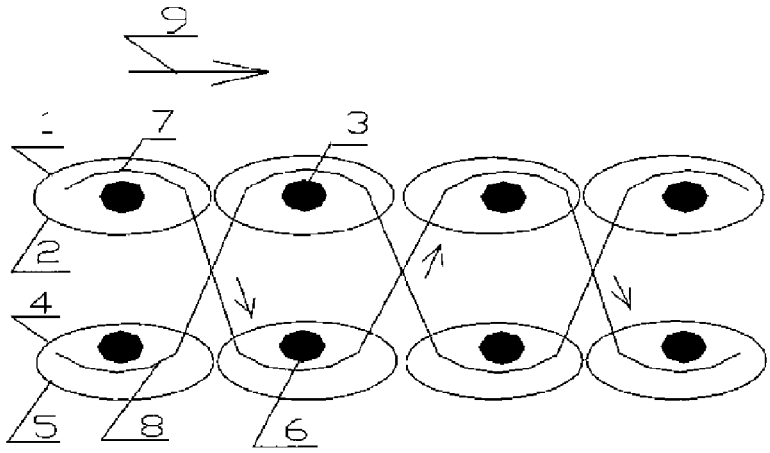
Fig. 1 (prior art)
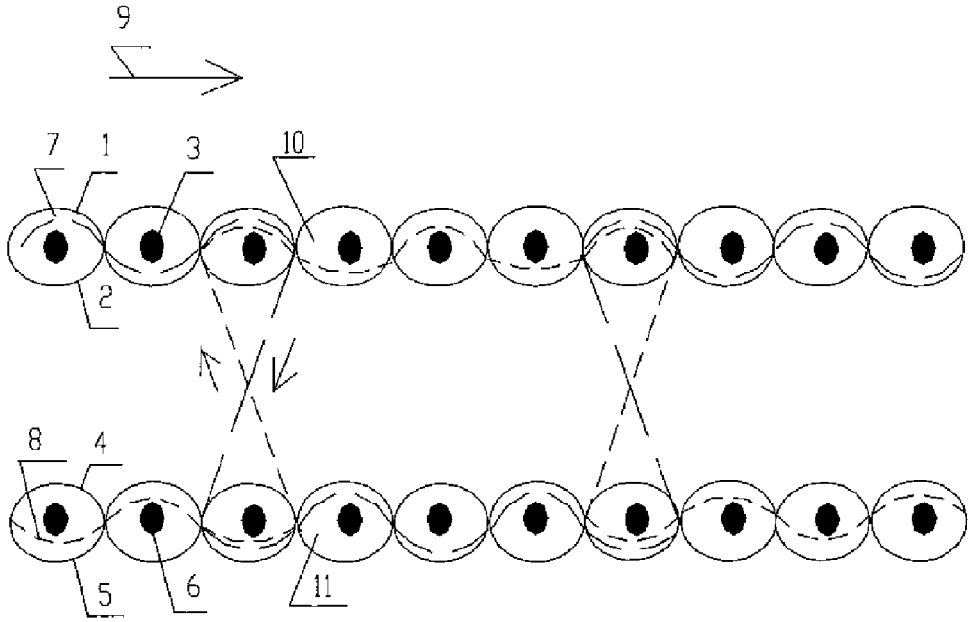
Fig. 2

THREE-DIMENSIONAL WOVEN HOLLOW LAYER-CONNECTING FABRIC

TECHNICAL FIELD

The present invention relates to a three-dimensional woven hollow layer-connecting fabric, which belongs to a technical field of a special woven fabric structure.

BACKGROUND ART

There are layer-connecting fabrics made of cotton or wool in the civil textile, which are also known as warp pile wool fabrics. The typical sorts are plain velvet fabric and plush fabric etc. Their common features are the use of double layer-connecting weave and that poil warps with only differences in length and density are uniformly sandwiched between the upper and lower layer weave by certain weaving design. For example, the upper layer weave of plain velvet weave (see FIG. 1) is formed by crossing warp yarns 1, 2 in pair with a row of weft yarns 3; the lower layer weave is formed by crossing warp yarns 4, 5 in pair with a row of weft yarns 6; and the double layer-connecting structure is formed by crossing poil warps 7, 8 with respective weft yarns of the upper and lower layers. The plain velvet fabric is finally made after the poil-cutting process. Poil warps of such fabric are connected with the upper and lower layer weaves by a "forward" (namely in the same direction as the weft-inserting direction of the fabric) manner of crossing for the reason that poil warps are respectively crossed with different weft yarns of different layers. The manner of crossing has problems that the fastness of crossing is low, the cloth fell oscillates greatly up and down during the weaving process and the pile height is limited. The length of poil warps of the plain velvet fabric is about 2 mm, and the length of poil warps of the plush fabric is about between 10 and 18 mm which needs special weaving manner. The products made of the plush fabrics are mostly used in the garment industry for achieving a certain costume effect. The layer-connecting fabrics are also widely used in architectural engineering, such as greatly-used geofabric and layer-connecting fabric used in the banks of reservoir.

In addition, the Chinese patent (00135845.6) introduces a hollow layer-connecting composite material, wherein the upper and lower layers of the fabric are connected "forwardly" by a poil warp; the pile height is 20-600 mm; the spatial height of the fabric is comparatively huge; the fabric is used to produce sound-proof materials and filling materials. However, it has the defects that the connecting manner of poil warps is simple, and spatial structure lacks variation. The lower strength of the framework of the composite material of the fabric affects its use as a structure material. European patent (DLE19609492), (93119483.1) and American patent (U.S. Pat. No. 5,175,034) introduce several kinds of layer-connecting fabrics. But in all the fabrics mentioned by these patents, the poil warps are crossed "forwardly" respectively with different weft yarns on each layer. The poil warps using such manner of crossing are easy to slidably move such that the fastness of poil warps is influenced. Therefore, the framework feature of the layer-connecting fabric made by the "forward" manner of crossing is not distinct, nor is the vertical support function of poil warps between two layers. These render the anti-pressure strength of the composite material decreasing and the mechanical properties fluctuating greatly. At present, the "forward" crossing structure of poil warps is adopted in weaving all kinds of layer-connecting fabrics developed home and abroad.

SUMMARY OF THE INVENTION

The problems to be solved by the present invention are that the poil warps are easy to slidably move such that the fastness of poil warps is influenced, the framework feature of the layer-connecting fabric is not distinct, and the vertical support function of poil warps between two layer-surfaces is not distinct, which are all caused by the "forward" crossing structure of poil warps adopted in weaving all kinds of existing layer-connecting fabrics.

To solve the above technical problem, the present invention adopts a structure that the poil warps and the weft yarns on the same layer-surface are crossed "backward". The specifics are as follows:

According to an aspect of the present invention, a three-dimensional woven hollow layer-connecting fabric is provided. The fabric includes an upper layer-surface, a lower layer-surface and a pair of poil warps connecting the upper layer-surface and the lower layer-surface. The upper layer-surface is formed by crossing a pair of upper ground warp yarns with a row of upper weft yarns by adapting plain or twill weave. The lower layer-surface is formed by crossing a pair of lower ground warp yarns with a row of lower weft yarns by adapting plain or twill weave. The poil warps are crossed with the upper well yarns and the lower well yarns to connect the upper layer-surface and the lower layer-surface. Specifically, the spacial walking direction of the poil warps from the upper well yarns to the lower well yarns and the spacial walking direction of the poil warps from the lower well yarns to the upper weft yarns are in a backward direction to the weft-inserting direction of the fabric.

Optionally, the length between the upper and lower layer-surfaces connected by the poil warps ranges from 0 to 50 mm.

The present invention can use high-performance continuous monofilament to weave, or use high-performance continuous multifilament to weave blendedly.

Compared with other types of layer-connecting fabrics, the biggest difference of the present invention lies in that the poil warps and weft yarns of this fabric are crossed in a "backward" way. The poil warps are crossed with the same weft yarn on the same layer-surface so as to form a particular pile spatial structure. "Backward" crossing can prevent poil warps from slidably moving in the fabric, render the framework feature of the compounded layer-connecting fabric distinct and the vertical support function of poil warps between two layer-surfaces good. The present invention also has the advantages of variations in conformation, being easy to design and adapted to produce on a large scale. The profile compounded and strengthened by this type of fabric has characteristics, such as anti-corrosion, anti-penetration, light weight and excellent physical mechanical properties, and is widely used in fields of aeronautics, astronautics, shipbuilding, petro-chemistry, underground storage tanks, architectural material, sports equipments and automobile manufacturing.

BRIEF DESCRIPTION OF THE DRAWINGS

FIG. 1 is a schematic illustration of the spatial structure of common plain velvet fabric.

FIG. 2 is a schematic illustration of the typical staggered structure of the fabric in accordance with the present invention.

DESCRIPTION OF THE PREFERRED EMBODIMENTS

Figure 3:
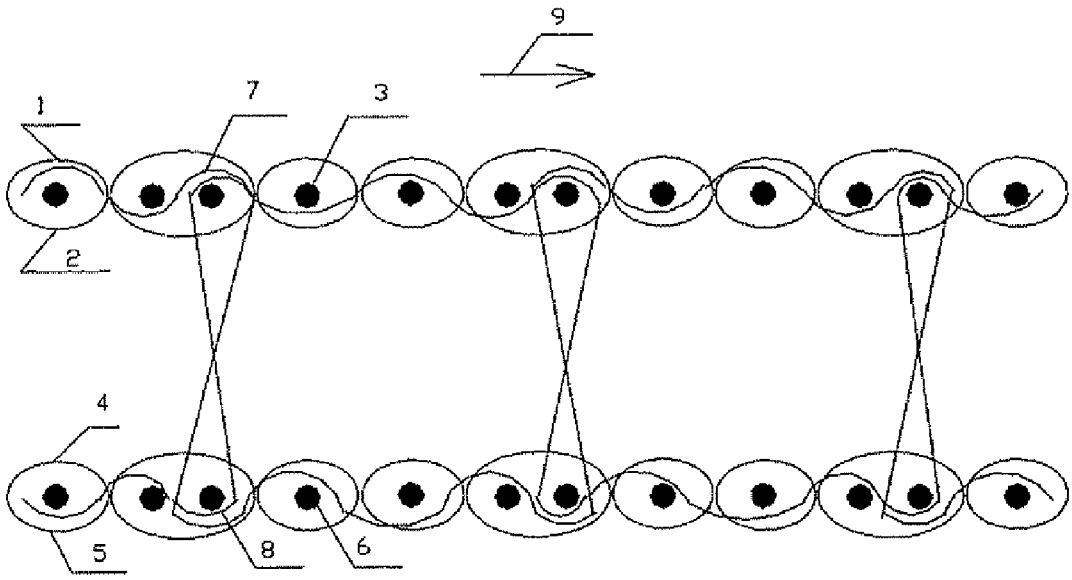
FIG. 3-5 are schematic illustrations of different ground weaves of the fabric in accordance with the present invention.

As shown in FIG. 2, an upper layer-surface 10 of the fabric is formed by crossing upper ground warp yarns 1, 2 in pair with a row of upper weft yarns 3 (ground weave is represent by plain weave); a lower layer-surface 11 of the fabric is formed by crossing lower ground warp yarns 4, 5 in pair with a row of lower weft yarns 6; and a pair of poil warps 7, 8 connect the upper and lower layer-surfaces 10 and 11 of the fabric. The upper poil warp 7 is crossed with an upper weft yarn and the lower poil warp 8 is simultaneously crossed with a corresponding lower weft yarn in the same vertical section, or vice versa, thereby forming a symmetrical spacial configuration. The spacial walking direction of the pair of poil warps 7, 8 between the upper layer-surface 10 and the lower layer-surface 11, when woven from one layer-surface to another layer-surface of the fabric, is opposite to the weft-inserting direction of the fabric (as indicated by an arrow 9), that is, crossed with the corresponding weft yarn 3 or 6 of another layer-surface in a "backward" direction. Taking the poil warps 7, 8 in FIG. 2 as an example, during the process of transiting from the upper layer-surface 10 to the lower layer-surface 11, the upper poil warp 7, after being crossed with one of the upper weft yarns 3, extends towards lower left direction as indicated by the arrow and then is crossed with a corresponding one of the lower weft yarns 6 on the lower layer-surface 11, whereas the direction of the fabric formation as indicated by the arrow 9 is from left to right to insert wefts alternatively such that a double-layer structure is formed. Therefore, the upper poil warp 7 is crossed with the lower weft yarns in a manner opposite to the normal weft-inserting direction; during the process of transiting from the lower layer-surface 11 to the upper layer-surface 10, the lower poil warp 8, after being crossed with one of the lower weft yarns 6, extends towards upper left direction as indicated by the arrow and then is crossed with a corresponding one of the upper weft yarns 3 on the upper layer-surface 10, whereas the direction of the fabric formation as indicated by the arrow 9 is from left to right to insert wefts alternatively such that a double-layered structure is formed. Therefore, the lower poil warp 8 is crossed with the upper weft yarns in a manner opposite to the normal weft-inserting direction as well.

The above transitional manner of the poil warps of the present invention is different from the "forward" crossing of other pile fabrics. Taking simple plain velvet fabric (see FIG. 1) as an example, before cutting pile of the plain velvet fabric, the upper warp yarns 1, 2 and the row of upper weft yarns 3 are crossed to form the upper layer weave; the lower warp yarns 4, 5 and the row of lower well yarns 6 are crossed to form the lower layer weave; and the poil warps 7, 8 are respectively crossed with respective weft yarns of the upper and lower layers to form a double layer-connecting structure. The spacial walking direction of the poil warps 7, 8 between two layer-surfaces of the fabric is the same as the weft-inserting direction of the fabric. Taking the upper poil warp 7 in the FIG. 1 as an example, during the process of transiting from the upper layer-surface to the lower layer-surface, the upper poil warp 7 extends towards lower right direction as indicated by the arrow and then is crossed with one of the lower weft yarns 6 on the lower layer-surface, and is in the same direction as that of the fabric formation (as indicated by the arrow 9, from left to right to insert wefts alternatively such that a double-layer structure is formed). The unit length of the poil warps between the fabric by using this crossing manner contributes little to the height between the fabric, and the anti-pressure strength of the composite fabric is low.

The advantages of the "backward" crossing structure of the present invention lie in that: due to the special spatial walking positions, the tension of poil warps can be well-retained upon weaving. The poil warps are not easy to slidably move for being closely connected with the upper and lower layers. The poil warps between the two layers of the fabric effectively support the fabric so that the fabric is stiffer than the fabric made by the "forward" crossing manner. Having been stretched under pressure, the upper and lower layer-surfaces of the fabric are easy to resile due to the stress effect of the poil warps such that the mechanical properties of the fabric are not easy to attenuate. On one side, this facilitates the storage and transportation of the fabric; on the other side, the fabric is ensured to keep a good spatial status during the compounding process (the two layer-surfaces are not easy to slidably move relative to each other). Because the "backward" crossing structure can ensure the warp yarns and weft yarns closely crossed, the pile height of the layer-connecting fabric using this structure can be 50 mm to the maximum, which improves the defect that the pile height using the "forward" structure is no more than 20 mm, so that the requirement of the material spatial thickness in the warm-keeping and heat-proof fields is satisfied. In the compounding process of the fabric, the tension of the poil warps is released instantly so that the fabric and the resin can be combined quickly and effectively. The molded poil warps are the framework of the composite material. Because the poil warps of the fabric using the "backward" crossing structure retain stress as much as possible, the strength of the compounded framework is comparatively high, which greatly increases the physical mechanical properties of the composite material. Under the same testing conditions and in the same manner, the mechanical properties of the material increased 15-35% compared with the material (the same standard) compounded by "forward" crossing. The poil warps of other layer-connecting fabrics are respectively crossed with weft yarns on different layer-surfaces; however, the poil warps of the fabric of the present invention are crossed with the same weft yarn on the same layer-surface so that the crossed positions of the poil warps are concentrated, the poil warps are closely connected to the weft yarns of the two layers, the spatial conformation of the poil warps are symmetrical and the framework of the compounded fabric is distinct.

The upper and lower ground weave of the present invention can be a plurality of weaves, such as plain, diversified plain and twill. In FIG. 3, the upper and lower ground weaves are diversified plain weaves. The upper ground warp yarns 1, 2 and the row of upper weft yarns 3 are crossed to form the upper layer-surface of the fabric, and the lower ground warp yarns 4, 5 and the row of lower weft yarn 6 are crossed to form the lower layer-surface of the fabric. The upper and lower poil warps 7, 8 connect the upper and lower layer-surfaces by using the "backward" crossing structure. The arrow 9 shows the formation direction of the fabric.

Figure 4:
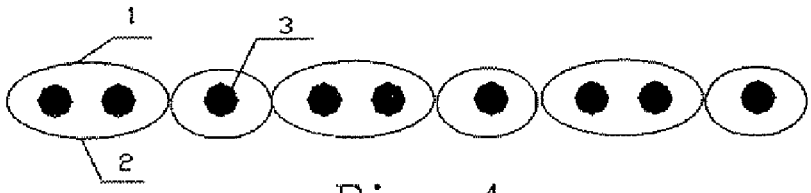

FIG. 4 shows a 2/1 twill ground weave. It can be seen from the figure that the ground warp yarns 1, 2 in pair and the row of weft yarns 3 are crossed to form a layer-surface of the fabric.

Figure 5:
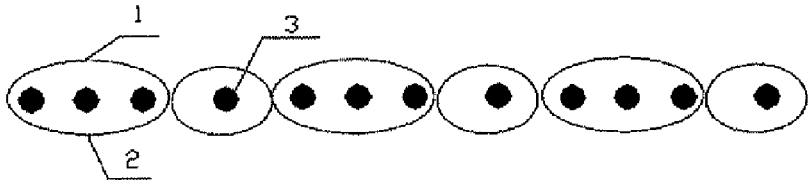

FIG. 5 shows a 3/1 twill ground weave. It can be seen from the figure that the ground warp yarns 1, 2 in pair and the row of weft yarns 3 are crossed to form a layer-surface of the fabric.

The design of the upper and lower ground weave of the fabric is to meet needs of different cloth application. To avoid the breaking of the poil warps on the fabric layer-surface caused by friction, diversified plain, twill, diversified twill weave etc. can be used to protect the poil warps; to improve the compact property of the fabric layer-surface, multi-crossed plain is used so as to have the warp yarns and weft yarns compactly crossed. Different weft yarns of the upper and lower ground weave have different gripping forces towards the poil warps. Generally speaking, the gripping force of diversified plain and twill to poil warps is greater than the gripping force of plain to poil warps.

Figure 6:
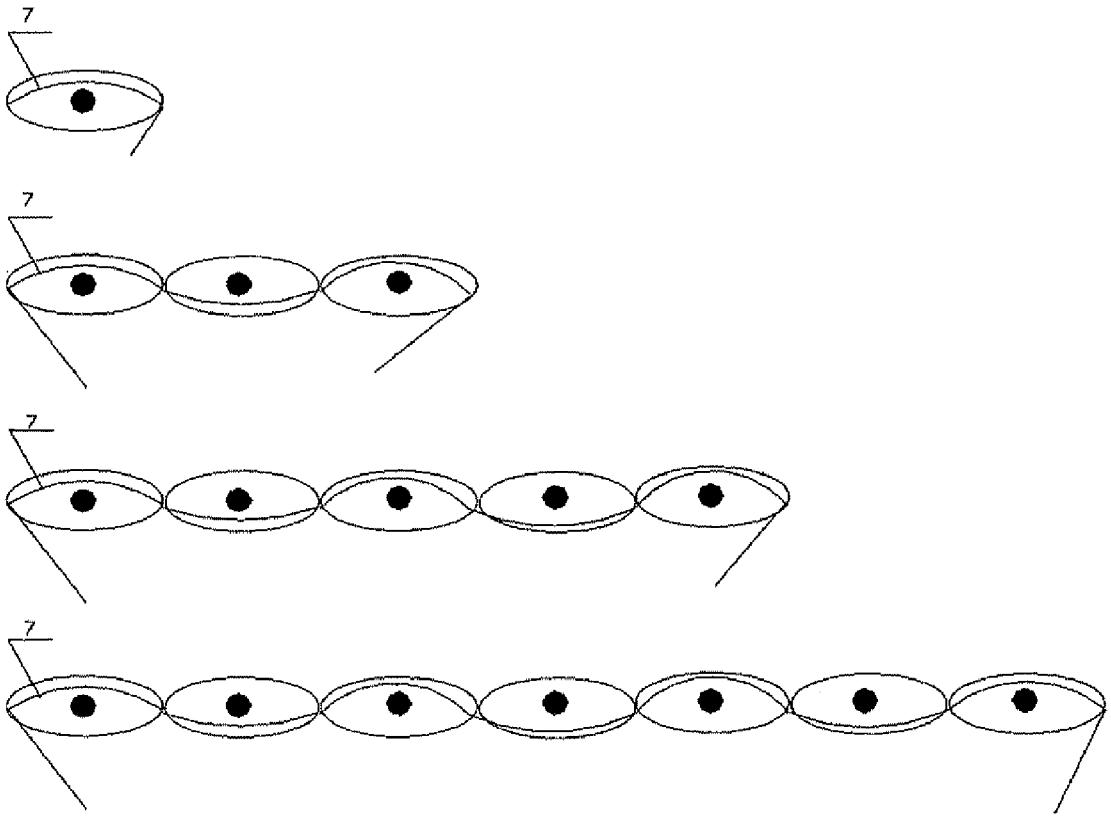
FIG. 6 is a schematic illustration of different weft spans of poil warps of the fabric in accordance with the present invention.

Referring to FIG. 6 of the present invention, the unit number of weft yarns crossed with poil warps on one layer-surface can be designed according to requirements. The weft span of the poil warp 7 on one layer-surface can be 1 weft yarn, 3 weft yarns, 5 weft yarns or 7 weft yarns. Generally speaking, the unit number of the weft yarns which the poil warps span on one layer-surface is 2n+1, wherein n is an integer. The design of the span of the poil warps on one layer-surface can control the distribution density of the poil warps in the fabric so that the spacial dimension between the frameworks can change within a certain range, which will meet the needs of different fillings and different filling weights to the interior space.

According to the present invention, single high-performance fibers, such as glass fibers, carbon fibers, aramid fibers, NOMEX fibers, PBO fibers and PTFE fibers, can be used to weave, the above fibers can also be used to weave blendedly so that the fabric has the physical and chemical advantages of a plurality of fibers, such as, glass fibers are used as warp yarns and carbon fibers as weft yarns to increase the strength and stiffness between the layers of the fabric.

What is claimed is:

1. A three-dimensional woven hollow layer-connecting fabric comprising:

an upper layer-surface formed by crossing a pair of upper ground warp yarns with a row of upper weft yarns, a lower layer-surface formed by crossing a pair of lower ground warp yarns with a row of lower weft yarns, and a first and a second poil warps concurrently crossed with the upper weft yarns and the lower weft yarns to connect the upper layer-surface and the lower layer-surface, such that:

during the process of transiting from the upper layer-surface to the lower layer-surface, the first poil warp, after being crossed with one of the row of upper weft yarns, is crossed with one of the row of the lower weft yarns, which corresponds to said one of the row of upper weft yarns in the same vertical section, and during the process of transiting from the lower layer-surface to the upper layer-surface, the second poil warp, after being crossed with said one of the row of the lower weft yarn, is crossed with said one of the row of upper weft yarns in the same vertical section, thereby forming a symmetrical spacial configuration, wherein the spacial walking direction of the first poil warp from the upper layer-surface to the lower layer-surface and the spacial walking direction of the second poil warp from the lower layer-surface to the upper layer-surface are in a backward direction to the weft-inserting direction of the fabric.

2. The three-dimensional woven hollow layer-connecting fabric according to claim 1, wherein the length between the upper and lower layer-surfaces connected by the poil warps ranges from 0 to 50 mm.

3. The three-dimensional woven hollow layer-connecting fabric according to claim 1 or 2, wherein the fabric comprises at least one of continuous monofilament or continuous multifilament.

4. The three-dimensional woven hollow layer-connecting fabric according to claim 1 or 2, wherein the unit number of the upper or lower weft yarns which the poil warps span on the upper layer-surface or the lower layer-surface is 2n+1, wherein n is a positive integer.

* * * * *